United States Patent [19]

Fischer

[11] Patent Number: 4,577,557

[45] Date of Patent: Mar. 25, 1986

[54] INK APPLICATION AND METERING APPARATUS FOR A PRINTING MACHINE

[75] Inventor: Hermann Fischer, Augsburg, Fed. Rep. of Germany

[73] Assignee: M.A.N. Roland Druckmaschinen Aktiengesellschaft, Offenbach am Main, Fed. Rep. of Germany

[21] Appl. No.: 676,784

[22] Filed: Nov. 30, 1984

[30] Foreign Application Priority Data

Dec. 10, 1983 [DE] Fed. Rep. of Germany ..... 3344778

[51] Int. Cl.[4] ..... B41F 7/02

[52] U.S. Cl. ..... 101/217; 101/350; 101/365

[58] Field of Search ..... 101/349, 350, 351, 352, 101/365, 217

[56] References Cited

U.S. PATENT DOCUMENTS

| | | | |
|---|---|---|---|
| 3,098,437 | 7/1963 | Tyma, Jr. et al. | 101/350 |
| 3,688,694 | 9/1972 | Preuss et al. | 101/350 X |
| 3,828,665 | 8/1974 | Ogura et al. | 101/350 X |
| 4,033,262 | 7/1977 | Johne et al. | 101/350 |
| 4,148,256 | 4/1979 | Fischer | 101/350 |

FOREIGN PATENT DOCUMENTS

| | | | |
|---|---|---|---|
| 1129446 | 5/1962 | Fed. Rep. of Germany | 101/352 |
| 2924635 | 1/1981 | Fed. Rep. of Germany | 101/350 |

*Primary Examiner*—Edgar S. Burr
*Assistant Examiner*—John A. Weresh
*Attorney, Agent, or Firm*—Frishauf, Holtz, Goodman & Woodward

[57] ABSTRACT

Individual ink disk or roller elements (4) are located, axially positioned next to each other on a roller transfer structure; to provide for smooth operation of the ink train rollers (5'), the disks or roller elements of the ink roller structure are in continuous surface engagement with an ink-receiving roller (5) forming part of the roller train, and driven at machine speed, and selectively shiftable about its circumference, by deflection of individual angled levers (6) for selective engagement with the next upstream ink transfer roller, receiving ink from an ink supply roller, operating at a speed slow with respect to machine speed and the ink transfer roller (3).

20 Claims, 7 Drawing Figures

FIG.2
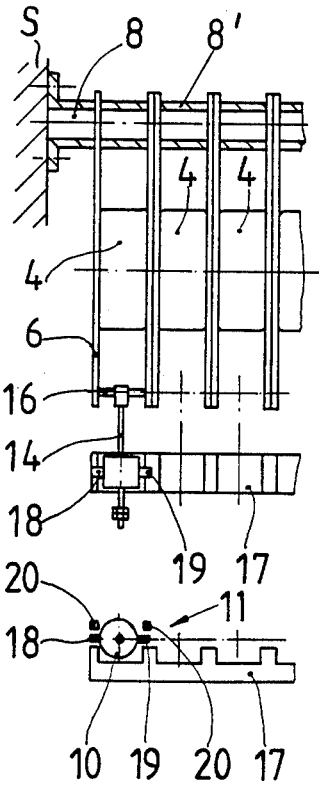
FIG.3
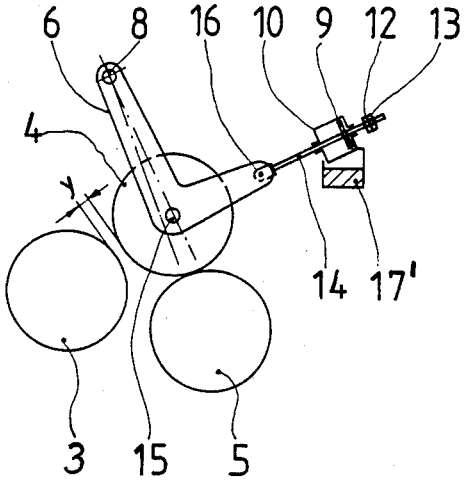
FIG.4

INK APPLICATION AND METERING APPARATUS FOR A PRINTING MACHINE

Reference to related applications, assigned to the assignee of the present invention, the disclosure of which is hereby incorporated by reference: U.S. Ser. No. 676,783, filed Nov. 30, 1984, Fischer; U.S. Ser. No. 676,781, filed Nov. 30, 1984 Fischer. Related patent: German Democratic Republic Patent DD-PS No. 104 259.

The present invention relates to printing machines, and more particularly to an ink application and metering apparatus, in which an ink transfer roller structure having a plurality of axially spaced disks is used to transfer ink from a metered layer on an ink transfer roller to an ink receiving roller in an ink roller train of the printing machine. The apparatus is particularly suitable for rotary offset printing machines.

BACKGROUND

It has previously been proposed—see German Democratic Republic Pat. No. 104 259—to provide an ink roller train in which a metering roller is included which is constructed as a plurality of axially spaced disks. The disks are, selectively, engaged with an ink supply roller and an ink receiving roller. It has been found that the arrangement there disclosed has a disadvantage, namely that the disks, during their engagement with the ink ink supply roller, are not available for milling of the ink film on the downstream ink-receiving roller and, further, that, upon selective engagement, cyclic acceleration and braking of the rollers occurs which, in addition to the shocks of impingement as the disks impinge on the ink-receiving roller, cause disturbances within the ink train and, specifically, within the drive gearing of the rollers of the ink train. These disturbances can be transferred to the printing cylinders, for example to the plate cylinder, and detrimentally affect the eventual printing result due to interference with continuous and desired supply of ink.

THE INVENTION

It is an object to utilize the advantage of an inking systems which includes disk-type ink rollers, without, however, being subjected to the disadvantages above referred to.

Briefly, in accordance with the invention, the roller transfer structure which is formed by a plurality of rotatable axially spaced disks or stub roller elements, is movably positioned in the roller train, and so located therein that it is in continuous surface engagement with the ink-receiving roller, that is, the roller downstream—in the direction of ink transfer—of the transfer roller structure with the spaced disks. Movement, thus, is essentially in a path about the circumference of the ink-receiving roller, so that no shocks or impingement vibrations are transferred thereto upon engagement of the respective disks with an ink supply roller; likewise, the continuous engagement permits milling, distributing, and splitting of the ink layer on the ink-receiving roller. No acceleration or braking effects will be transferred to the ink-receiving roller, since the respective disks or roller elements of the transfer structure continuously rotate at the circumferential speed of the ink-receiving roller.

The arrangement has the additional advantage that the ink transfer structure can be readily added to conventional, already constructed inkers, without substantial change or modification of the overall roller arrangement, or its placement in the overall inker structure.

In accordance with a feature of the invention, the spaced disks or roller elements are movably supported for selectively establishing a continuous serial linear transfer path of ink through the ink roller train, from an ink supply, or interrupting said path from the ink supply, the ink-receiving roller being driven to operate at machine speed, as well as an ink transfer roller which, selectively, transfers ink to the spaced disks. The spaced disks or roller elements, themselves, are so located that they are in continuous surface engagement with the ink-receiving roller but, selectively, in engagement with the ink transfer roller, driven therefrom by frictional engagement therewith to pick up, from the ink transfer roller, the respectively required ink in a specific printing zone which is to be supplied by the selected disks.

DRAWINGS

FIG. 2 is a fragmentary side view showing pneumatic control for respective ink disks;

FIG. 3 is a schematic side view illustrating the operation of the pneumatic control;

FIG. 4 is a fragmentary schematic view illustrating the bearing arrangement for a plurality of pneumatic control units;

DETAILED DESCRIPTION

Figure 1:
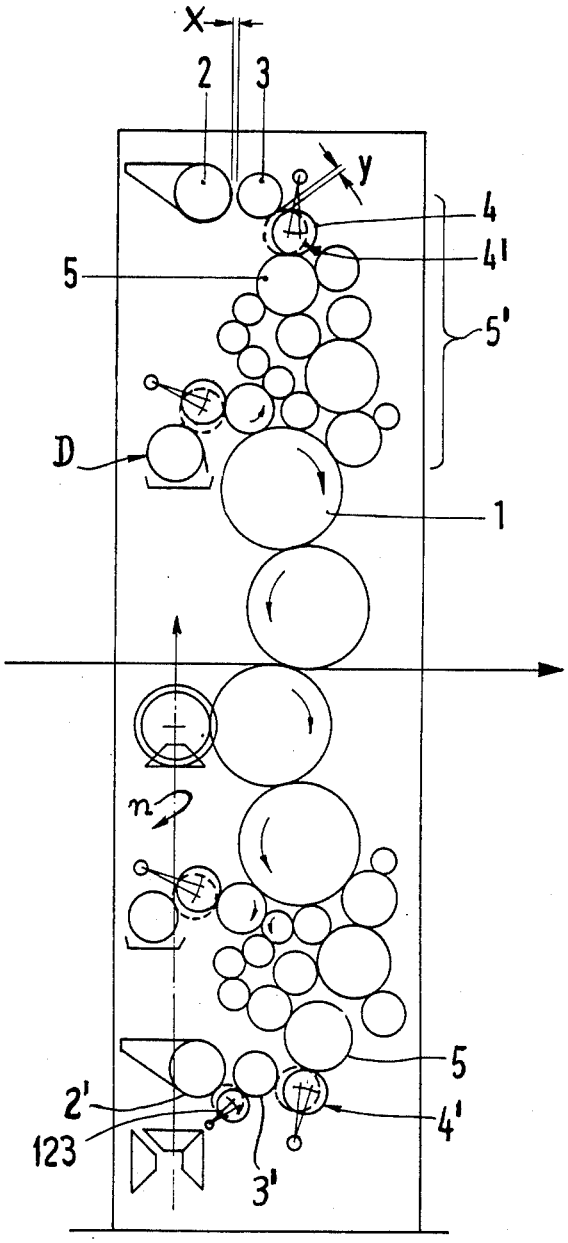
FIG. 1 is a schematic side view of a printing machine having an ink train which, generally, can be conventional, modified, however, by the structure in accordance with the present invention.

FIG. 1 illustrates, highly schematically, a printing station of a perfecting-type rotary offset printing machine; only those elements necessary for an understanding of the present invention have been given reference numerals, since all other elements are entirely conventional.

An ink roller 2 is in operative ink-receiving position with respect to an ink trough, so that a metered amount of ink is transferred to the ink roller 2, for example by a suitably adjusted doctor blade. The ink supply roller 2 is spaced from an ink transfer roller, downstream of the ink roller, by a gap x which, for example, may have a width in the order of about 0.05 mm. The ink supply roller 2 is driven at a speed which is slow with respect to machine speed; the ink transfer roller 3 is driven with a circumferential linear speed which corresponds, essentially, to the circumferential linear speed of the plate cylinder 1, which is substantially higher than the linear speed of the ink supply roller 2. Ink is transferred from the supply roller 2 to the transfer roller 3. The initial metering of the ink layer on the supply roller 2 can be in accordance with any well known and suitable arrangement, for example by means of a customary doctor blade. The speed relationships, namely the substantially slower speed of the ink supply roller 2 with respect to the film rollers forming the ink train supplying ink to the plate cylinder, and operating at circumferential plate cylinder speed, is well known, and the system in accordance with the present invention also utilizes this known feature.

A different type of ink supply system may be used, which is shown in the lower half of the printing machine, at the verso printing unit, where an ink supply roller 2 is spaced from the ink transfer roller 3, and ink is transferred to the transfer roller 3' by a movable lifting roller 123. The ink transfer roller 3', preferably, is a milling-type or or distributing-type roller.

Ink is transferred from the ink transfer roller 3 to an ink-receiving roller 5 by an ink transfer roller structure 4' which is formed by a plurality of ink metering disks, or roller elements 4 (FIGS. 2, 3). The ink metering disks or roller elements 4 are so located that they are positioned adjacent each other, spaced axially from each other, located between two rollers of the ink train, generally shown at 5' in FIG. 1. Preferably, the ink transfer metering roller structure 4' is positioned close to the ink supply roller 2, that is, between the first two rollers of the ink train 5' which operate at machine speed, namely the rollers 3 and 5. Both rollers 3 and 5 are driven at machine speed. Preferably, the ink-receiving roller 5 is a milling-type or distributing-type roller.

In accordance with a feature of the invention, the ink metering disks 4 are in continuous surface engagement with that one of the rollers which is downstream in the path of ink transfer, in the example selected with the roller 5 which is the roller closest to the plate cylinder 1. Consequently, the disks or roller elements 4 are in continuous engagement with a roller which is available for milling, and distribution of the ink layer on the roller with which the metering rollers 4 are in contact. Ink pick-up or transfer by the invidivual elements 4, however, can be individually controlled so that the roller 5 will have more, or less, ink applied thereto over respective axial zones thereof.

In order to maintain continuous contact of the disks or roller elements 4 with the ink-receiving roller 5, the rollers 4 are movably supported in a support arrangement which guides the rollers or disks 4, at least roughly, in an arcuate path about the ink-receiving roller 5. Upon shift in the rollers, the elements 4 will then, selectively, engage or not engage the ink transfer roller 3, and thus transfer ink from the transfer roller 3 to the ink-receiving roller 5, as commanded or controlled; contact with the ink-receiving roller 5, however, is continuously maintained, so that milling effect on the ink can be continuously maintained as well.

The movement or shift in an arcuate path of the ink metering disks or roller elements 4 about the roller 5 may be a very small movement, for example only a few tenths of a millimeter.

The remaining rollers of the ink train 5' have not been given specific reference numerals, since they can all be conventional, applying ink to the plate cylinder. A damper D is shown only schematically, and can be of conventional construction.

The ink metering disk or roller elements 4 are selectively applied by a mechanism shown in greater detail in FIGS. 2–4. As best seen in FIGS. 2 and 3, the elements 4 are located in axial alignment, adjacent each other, but separated from each other by spacing bushings 8', thereby defining the axial zone positions of the disks or roller elements 4. Each roller element or disk 4 is held in position by at least one—preferably two—angled pivot levers 6. Preferably, one pivot lever 6 is located at each end face of an element 4. One end of the pivot lever 6 is pivotably secured on a shaft 8, on which the bushings 8' are located. Shaft 8 is secured to a side wall S of the printing machine. The levers 6 are angled levers—see FIG. 3—and the opposite end thereof is pivotably linked, at 16, to a control apparatus, preferably a cylinder-piston arrangement which may be operated pneumatically, hydraulically, or may be replaced by an electromagnetic structure. In the example selected, the control arrangement is a pneumatically operated piston-cylinder combination, having a piston 9 operable within a cylinder 10. The piston 9 is movable to cover the path or distance y, and is pivotably secured in a bearing 11 (FIG. 4). The stroke of the piston 9 can be adjusted by setting nuts 12, 13 which, for example, can be engaged against the cylinder 10, respectively, or against a fixed abutment 17' of the machine.

The engagement force of the respective disks or roller elements 4 in the direction of the roller 3 will be determined by the air pressure within the cylinder 10. The disks or roller elements 4 are located centrally on the lever 6, rotatable about a pin 15. The piston rod 14 is pivotably connected by a bolt 16 with an end of the lever 6. To engage the respective disks or roller elements 4 in the direction of the ink-receiving roller 5, the levers 6 are preferably located on a shaft 8 by means of eccentric elements.

In accordance with a feature of the invention, continuous contact is maintained between the ink metering disks or roller elements 4 and the ink-receiving roller 5. This contact is maintained even if the circumference of one of the engaging elements, that is, the disks or elements 4 or the roller 5, respectively, becomes worn.

Figure 5:
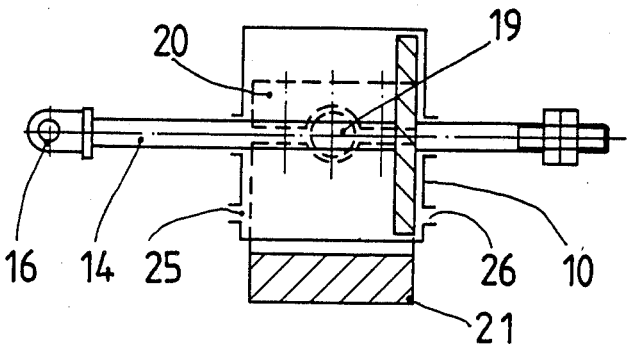
FIG. 5 is a schematic detail view of a bearing arrangement for a pneumatic control element.

The cylinder 10 is preferably retained to be pivotable within a bearing 11, in order to carry out the movement of the respective disks or roller elements 4 about or around the circumference of the ink-receiving roller 5, in the direction of the ink transfer roller 3 over the path distance y. The cylinder 10, as best seen in FIGS. 4 and 5, has lateral stub shafts 18, 19 secured thereto which, preferably, are journalled in a common comb strip 17. These stubs 18, 19, which form bearing pins, are retained in position and closed off by a bearing cover 20. A common support base 21 is provided to receive the bearing pins 18, 19.

The system is controlled by a control unit 23 which controls the required ink in respective axial zones to be transferred to the receiving roller and hence through the roller train to the plate cylinder 1. The control unit is shown connected only to one cylinder; a plurality of outputs 23' from the control unit will be provided, however, one to each one of the control units 9, 10 for the respective disks or roller elements 4. The control unit may be arranged to provide ink supply, in accordance with preset, manual requirements, as determined by the subject matter to be printed, or can be automatically controlled based on ink requirements, as communicated to the control unit by a sensing structure, well known in the prior art, and determining the respective ink requirement in axial zones, to be transferred to the plate cylinder.

Figure 6:
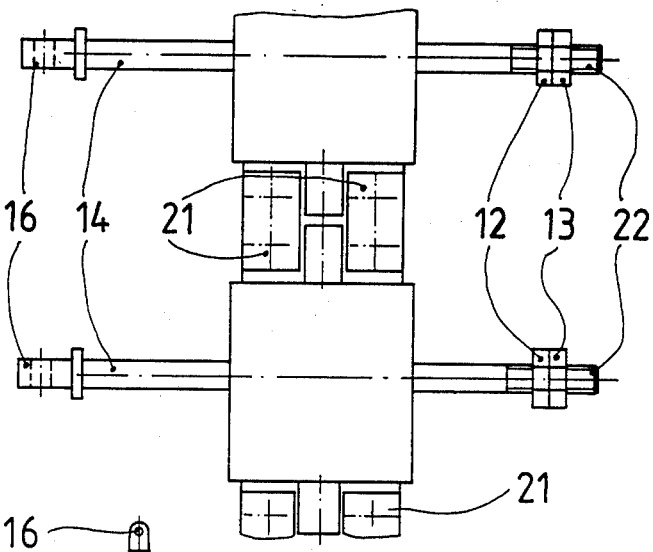
FIG. 6 is a schematic detail view of a bearing arrangement for a plurality of pneumatic control elements.
Figure 7:
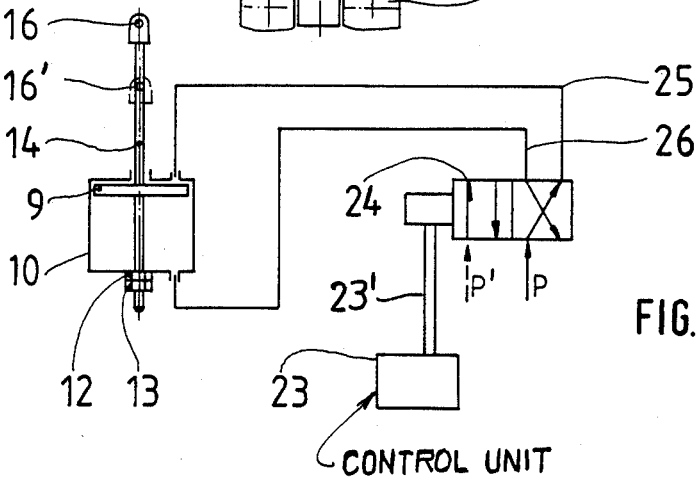
FIG. 7 is a valving and control diagram for pneumatic control of respective disks of the transfer roller structure.

The control unit 23 has the output 23' connected for a specific piston-cylinder combination in form of an electrical signal applied to a magnetic control valve 24 which receives, for example, compressed air shown schematically by the arrows P, P'. The magnetic control valve 24, selectively, applies compressed air to the output lines 25, 26,in accordance with the output from the control unit, to thereby control movement of the piston 9 within the cylinder 10. For example, if compressed air P' is supplied over line 26, piston rod 14 is projected and the bolt and like 16 will assume the position shown in FIG. 7 in full lines. Upon application of compressed air to line 25, as shown by the arrow P, the piston 9 will be moved downwardly—with respect to FIG. 7—and the piston rod 14 will be retracted, moving the pivot bolt 16 to the broken-line position shown at 16'. The movement is transferred over the lever 6 to the respective disk or roller element 4 which will roll about the circumference of the ink-receiving roller 5 to, selectively, contact the roller 3, or leave the space y therefrom. The two positions of the roller elements or disks 4 of the structure 4' are shown in FIG. 1, in, respectively, full-line and broken-line position. It should be noted that in both positions, the roller elements 4 are in contact with the ink-receiving roller 5. The adjustment nuts 12, 13 are threaded on an end portion of the piston rod 14, as best seen in FIG. 6, for appropriate adjustment against, for example, the abutment 17'.

Various changes and modifications may be made within the scope of the inventive concept.

I claim:

1. Ink application and metering apparatus for a printing machine, particularly rotary offset printing machine, having a plate cylinder (1) being driven at a predetermined circumferential machine speed;

an ink supply (2) carrying a film of ink of predetermined and controlled thickness, and driven at a speed which is slow with respect to machine speed;

an ink film transfer roller (3) driven at machine speed and having ink in film form applied thereto from the ink supply roller (2);

an ink roller train (5') transferring ink from the ink film transfer roller (3) to the plate cylinder of the printing machine, and operating at machine speed, said ink roller train including an ink transfer roller structure (4') having a plurality of rotatable, axially spaced roller elements (4), said ink roller train (5') including an ink-receiving roller (5), engageable by said roller elements (4');

means (6) for movably supporting said spaced roller elements for selectively controllably establishing a continuous serial linear ink transfer path from the ink film transfer roller (3) to the ink receiving roller (5), or selectively, interrupting said continuous transfer path, wherein, the ink film transfer roller (3) and the ink-receiving roller (5) are driven to operate at machine speed;

and the support means (6) individually support the individual roller elements (4) in continuous surface engagement with the ink-receiving roller (5), means for mounting said support means for individual movements of selected roller elements about an axis located on the opposite side of said roller elements from said ink-receiving roller, said mounting means including means to maintain engagement of said ink-receiving roller and said roller elements as said support means is moved about said axis for controlled individual selective movements through a movement path (y) toward and up to engagement with the ink film transfer roller (3) for relative application of ink from the ink film transfer roller to the ink-receiving roller, as selectively controlled in axially spaced zones in accordance with selective engagement or with controlled disengagement of said roller elements with the ink film transfer roller (3);

the ink supply roller (2) and the ink film transfer roller (3) are spaced from each other by an ink transfer gap (x) transferring ink, but permitting bridging of speed difference of the relatively slow speed of the ink supply roller and the machine speed of the ink film transfer roller (3);

and wherein the roller elements (4) of the transfer roller structure are driven by surface-frictional engagement with the ink-receiving roller (5).

2. Apparatus according to claim 1, wherein said support means comprises a plurality of angled lever (6) associated with respective roller elements (4), each angled lever having one end pivoted about a fixed shaft (8);

and operating elements (9, 10, 14) coupled to the other ends of the angled levers.

3. Apparatus according to claim 2, including a pair of bearing pins (18, 19) pivotably retaining the operating elements in position in the printing machine;

the operating elements being pivotably secured to the respective angled levers at approximately the apex of the angled levers, pivotable movement of the operating element permitting at least approximately circular displacement of the roller elements (4) along the circumference of the ink-receiving roller (5).

4. Apparatus according to claim 2, wherein at least one angled lever (6) is provided for each roller element 4;

and wherein individual elements (9, 10, 14) are operatively associated with selected roller elements (4) and connected to at least one of the angled levers (6) supporting respective roller elements (4).

5. Apparatus according to claim 3, wherein at least one angled lever (6) is provided for each roller element (4);

and a common support strip (17) is provided retaining said bearing pins in position in the machine.

6. Apparatus according to claim 2, wherein the operating elements comprise cylinder-piston units.

7. Apparatus according to claim 2, wherein the cylinder-piston units comprise a fluid operated cylinder-piston units;

and a magnetic control valve means (24) is provided, controlling respective fluid operated cylinder-piston units.

8. Apparatus according to claim 6, wherein at least one individual angled lever (6) is provided for operatively movably retaining an individual roller element (4) in position against the ink-receiving roller (5), and, selectively is movable toward said ink film transfer roller (3);

and wherein individual control elements (24) are provided for controlling the respective operating elements (9, 10, 14).

9. Apparatus according to claim 8, wherein the operating elements are pneumatic cylinder-piston units;

and the individual control means comprise magnetic control valves.

10. Apparatus according to claim 2, wherein the angled levers are eccentrically rotatable about the shaft (8).

11. Apparatus according to claim 3, wherein the angled levers are eccentrically rotatable about the shaft (8).

12. Apparatus according to claim 7, wherein the angled levers are eccentrically rotatable about the shaft (8).

13. Apparatus according to claim 1, including adjustable stop means (7; 12, 13, 17′, 22) for controllably adjusting the extent of movement of the roller elements (4) with respect to the ink film transfer roller (3) when being moved toward the ink film transfer roller by said support means.

14. Apparatus according to claim 13, wherein the support means include coupling rods (14) and the adjustable stop means include adjustment nuts (12, 13) threaded on the coupling rods and engageable against a fixed stop (10, 17′).

15. Apparatus according to claim 2, wherein the support means include coupling rods (14) and the adjustable stop means include adjustable nuts (12, 13) threaded on the coupling rods and engageable against a fixed stop (10, 17′).

16. Apparatus according to claim 9, wherein the operating elements include piston rods (14), and the adjustable stop means include adjustable nuts (12, 13) threaded on the piston rods and engageable against a fixed stop (10, 17′).

17. Apparatus according to claim 1, wherein said ink-receiving roll (5) is an axially reciprocating ink milling roll.

18. Apparatus according to claim 2, wherein said ink-receiving toll (5) is an axially reciprocating ink milling roll.

19. Apparatus according to claim 7, wherein said ink-receiving roll (5) is an axially reciprocating ink milling roll.

20. Apparatus according to claim 12, wherein said ink-receiving roll (5) is an axially reciprocating ink milling roll.

* * * * *